US005626311A

United States Patent [19]

Smith et al.

[11] Patent Number: 5,626,311

[45] Date of Patent: May 6, 1997

[54] METHOD OF GUIDING MISSILES

[75] Inventors: Charles P. Smith, Harvard; John A. Beale, Lunenburg, both of Mass.

[73] Assignee: Raytheon Company, Lexington, Mass.

[21] Appl. No.: 256,676

[22] Filed: Oct. 12, 1988

[51] Int. Cl.[6] ..... F41G 7/22

[52] U.S. Cl. ..... 244/3.16

[58] Field of Search ..... 244/3.15, 3.16, 244/3.17; 235/411, 412

[56] References Cited

U.S. PATENT DOCUMENTS 3,416,752 12/1968 Hembree ..... 244/3.17
3,586,770 6/1971 Bonebreak et al. ..... 244/3.17
3,955,046 5/1976 Ingham et al. ..... 244/3.17
4,133,004 1/1979 Fitts ..... 244/3.16
4,162,775 7/1979 Voles ..... 244/3.17

*Primary Examiner*—Charles T. Jordan
*Attorney, Agent, or Firm*—Donald F. Mofford

[57] ABSTRACT

A method of guiding missiles in the terminal phase of an intercept. An image of the target area is stored as a reference. The reference is expanded by an amount which increases as the missile approaches the target. The expanded reference is then correlated to successively formed images of the target and the results of the correlation are used to guide the missile. The amount of expansion of the reference is selected to compensate for growth of the image as the missile approaches the target. A filter used to filter the successively formed images is adjusted to correspond to the amount of expansion in the reference.

4 Claims, 4 Drawing Sheets

METHOD OF GUIDING MISSILES

BACKGROUND OF THE INVENTION

This invention relates generally to guided missiles, and more particularly to a method of terminal guidance of such a missile.

One known method for determining the position of the target is based on processing signals from a TV or infrared (IR) imaging system to derive the requisite guidance commands. Ordinarily the signals out of an IR or TV sensor are converted to an array of digital words (sometimes hereinafter called "pixels") with the value of each word representing the intensity of IR energy radiating from a different point within a field of view. Electronic circuitry then is used to process the array to select any cluster of pixels that is known, a priori, to correspond with a cluster indicative of a target. Further processing of a selected cluster in any conventional fashion finally produces the requisite guidance commands. These commands are usually based on features of the target including its edges, which define its shape and angular size as seen by the imaging system. Successive frames from the imaging system are processed with the guidance commands generated for each frame, to guide the missile until it intercepts its target.

A problem arises in guiding the missile as it nears its target. The field of view of the IR sensor is generally very narrow. As the missile approaches the target, the target fills more and more of the field of view, creating an effect similar to what is observed when a camera is "zoomed" in for a closeup (sometimes hereinafter called "growth" of the image). At some time during the approach, the target fills the entire field of view. From that time on, the missile is deemed to be in the "terminal phase". During the terminal phase, the features used to generate guidance commands, particularly the edges of the target, may disappear. As the features disappear, the guidance commands may become indeterminate. Alternatively, the system may guide the missile towards an edge which stays in the field of view, and some percentage of missiles will miss the target.

Even in the terminal phase it may be necessary to make course corrections to guide the missile toward the target. In some instances, the field of view of the sensor may be so narrow or the target so large that the missile is an appreciable distance from the target when the target fills the field of view. Without guidance, the missile could drift appreciably off its desired course as it traveled that distance and might miss the target entirely. Alternatively, the target might be so large that the missile must strike a particular aim point in the target to be effective. In such instances, course corrections are needed during the terminal phase of the missile flight to guide it toward the aim point.

One known guidance technique which does not depend upon particular features of the target being within the field of view is correlation tracking. In correlation tracking, a stored scene is compared with the scene from the imaging system. The amount and direction the stored scene must be moved to best match the scene from the imaging system determines the magnitude and direction of the guidance command.

As the missile enters the terminal phase, the image of the target is stored as a reference. The images in successive frames from the imaging systems are then compared with this reference scene to derive the guidance information. Thus, the aim point contained in the reference scene is preserved.

Since the image continues to grow as the range to target decreases, the stored image, which is not growing, will soon not correlate with images in the successive frames. At this point, a new reference image must be exchanged for the stored image. Exchanging reference images continues at an ever increasing rate until target impact.

Every time the stored reference image is exchanged, it incorporates whatever error is present. For example, error is introduced if the first image is exchanged for an image representing a portion of the target slightly offset from the portion of the target represented by the center of the first image. Exchanging images therefore results in noise and drift in the guidance command. The more often the reference scene is exchanged, the larger the drift in guidance command will become. This drift will result in the missile missing its original aim point, and the greater the drift, the greater the miss.

If one considers an incremental area on the target offset from the aim point of the missile and within the field of view, two phenomena are present as one observes the image received by the missile guidance system as the aim point is approached. First, points in the image of the incremental area move out radially from the aim point at a rate proportional to both the velocity of the missile and the distance between the aim point and the incremental area. Second, the portion of the image representing that incremental area on the target will grow in an angular size as seen by the sensor as the range decreases. To reduce the number of required reference scene updates, a correlation tracker must address these phenomenon.

In a known variation of a correlation tracker, a cluster of pixels in the image made of the target as it enters the terminal phase is selected as a reference cluster. That cluster is divided into a predetermined number of subclusters. As successive frames are produced, the reference subclusters are independently matched to clusters in the frames. Guidance commands are generated based on the amount and direction each of the subclusters must be moved to best match a portion of the image in a successively generated frame.

The foregoing approach compensates partially for changes between the successive images by allowing the subclusters to be matched to areas that have moved radially outward from the center of the image. It would be desirable to provide an approach which also compensates for growth of the subclusters. It would also be desirable to provide an approach which is computationally simple.

SUMMARY OF THE INVENTION

With the foregoing background of the invention in mind, it is an object of this invention to provide a method of guiding an air-to-ground missile during the terminal phase of an intercept.

It is another object of this invention to provide a computationally simple method to guide a missile which accounts for radial expansion and growth of images.

The foregoing and other objects are accomplished by sequentially processing images of the target area. A first image is selected as a reference prior to the missile entering the terminal phase. A portion of the image is stored as a reference array. The reference array is expanded by adding a first and second number of rows and columns to form a first and second expanded reference arrays, respectively. Both expanded reference arrays are then correlated to a second of the sequentially formed images and the expanded reference array producing the highest score is selected. Guidance commands are generated for the missile in response to correlation results. Expander logic, in response to the correlation scores, adjusts the first and second number of rows and columns added to the reference array to maximize the correlation scores. The expander logic also controls the center frequency of a band pass filter which filters the signals representing the sequentially generated images.

BRIEF DESCRIPTION OF THE DRAWINGS

The foregoing features of the invention may be more fully understood from the following detailed description and the accompanying drawings in which.

DESCRIPTION OF THE PREFERRED EMBODIMENT

Figure 1:
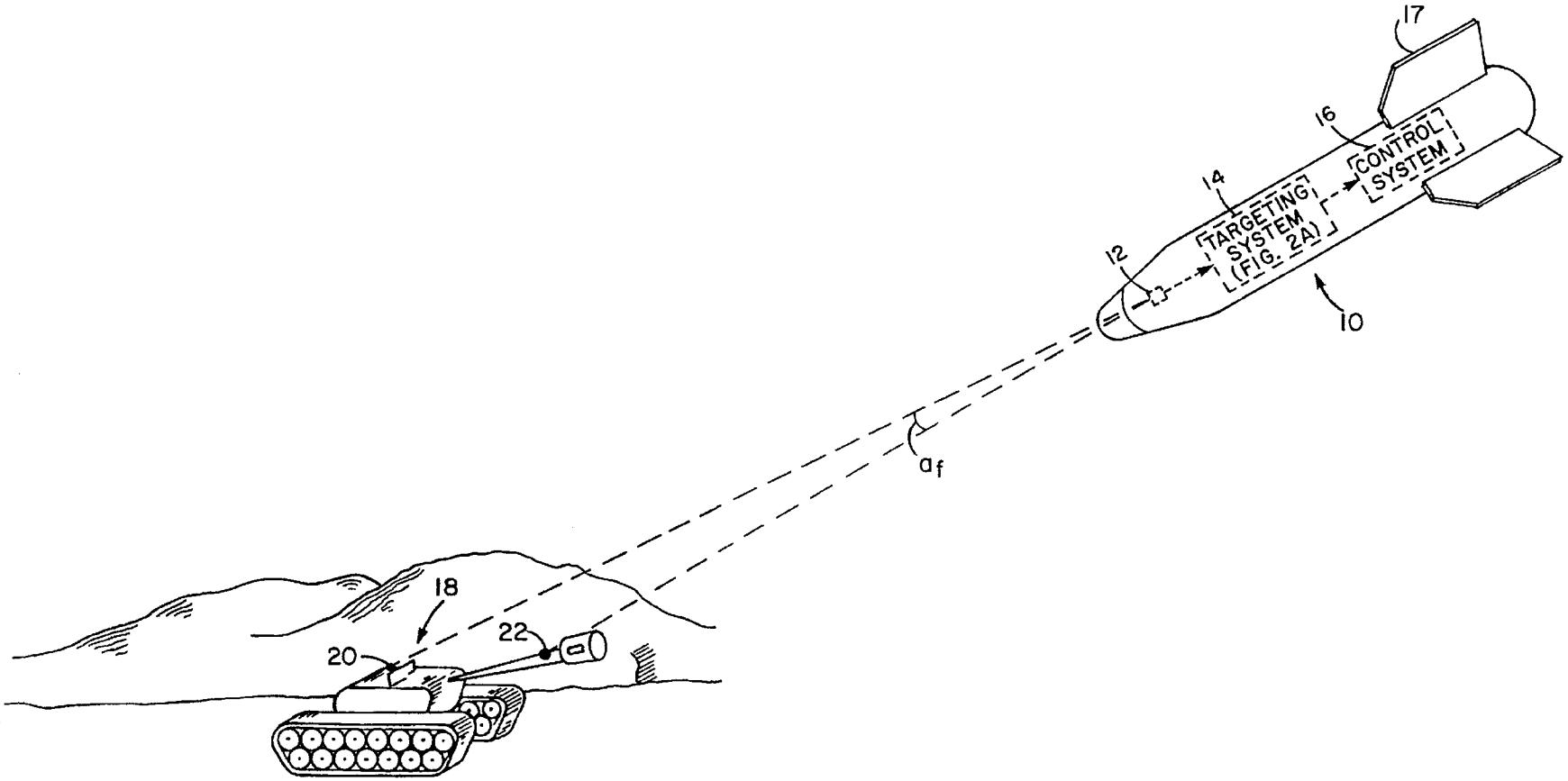
FIG. 1 is a simplified sketch of a scenario in which the present invention might be employed.

FIG. 1 shows a scenario in which the invention might be employed. A missile 10 is fired (possibly from an aircraft, not shown) at a target 18. The missile contains a seeker head 12 which forms a frame representing objects within its field of view. Each frame consists of a stream of analog data representing objects within the field of view. Here, seeker head 12 forms frames containing IR images, but one skilled in the art will recognize that seeker head 12 might employ other imaging techniques, such as forming images from visible light.

Targeting system 14 is responsive to the array to compute guidance commands to control the flight path of the missile to an intercept at any desired point on the target 18. The guidance commands are passed to a control system 16 wherein control signals for control surfaces 17 of the missile are generated. Frames are formed sequentially by seeker head 12 at a periodic rate of, say, thirty times a second, and control signals are generated periodically at the same rate.

Seeker head 12 has a narrow field of view which subtends an angle such as that labeled "$a_f$". It should be noted that the field of view actually is encompassed by a solid angle. For simplicity, a cross-section of the field of view is shown in FIG. 1. For the missile position depicted in FIG. 1, the whole field of view is taken up by the portions of the target 18 between points 20 and 22. The missile 10, as shown, may thus be deemed to be in the terminal phase.

The construction of the missile 10 with a control system 16 and control surfaces 17 is known in the art. Similarly, the construction of a seeker head 12 is known. The details of targeting system 14 constructed according to the present invention are described below.

Figure 2:
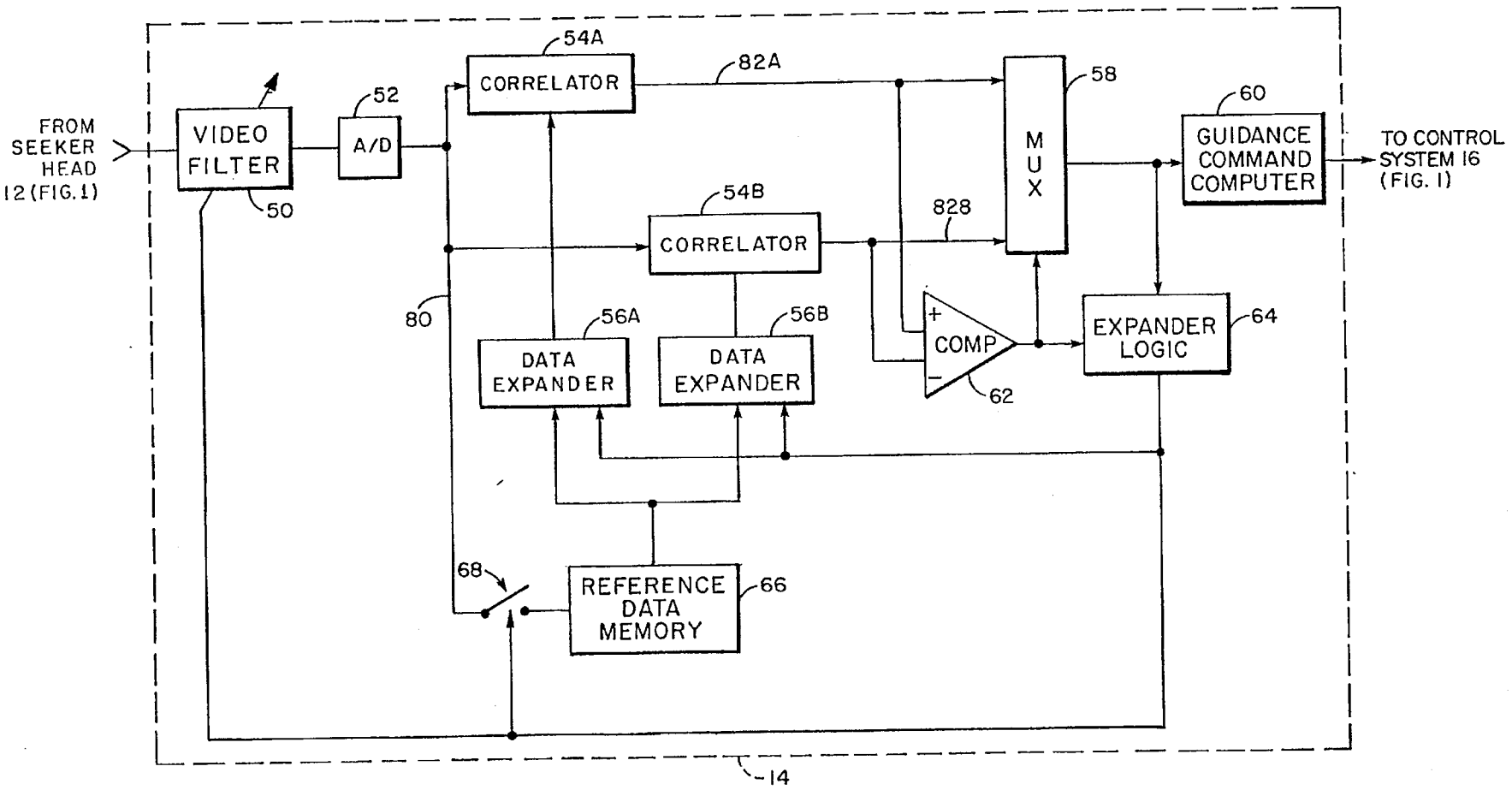
FIG. 2 is a block diagram of an image correlator constructed in accordance with the present invention.

FIG. 2 is a block diagram of targeting system 14 (FIG. 1). One skilled in the art will recognize that the system might be implemented using known hardware components. One skilled in the art will also recognize that timing, power and control signals, as well as other standard elements of signal processing circuitry, are not explicitly shown.

The analog video signal from seeker head 12 is applied to video filter 50. Video filter 50 is a band pass filter with an adjustable center frequency. Here, the pass band of filter 50 is adjusted in response to expander logic 64 in a manner to be described in greater detail below.

Figure 3B:
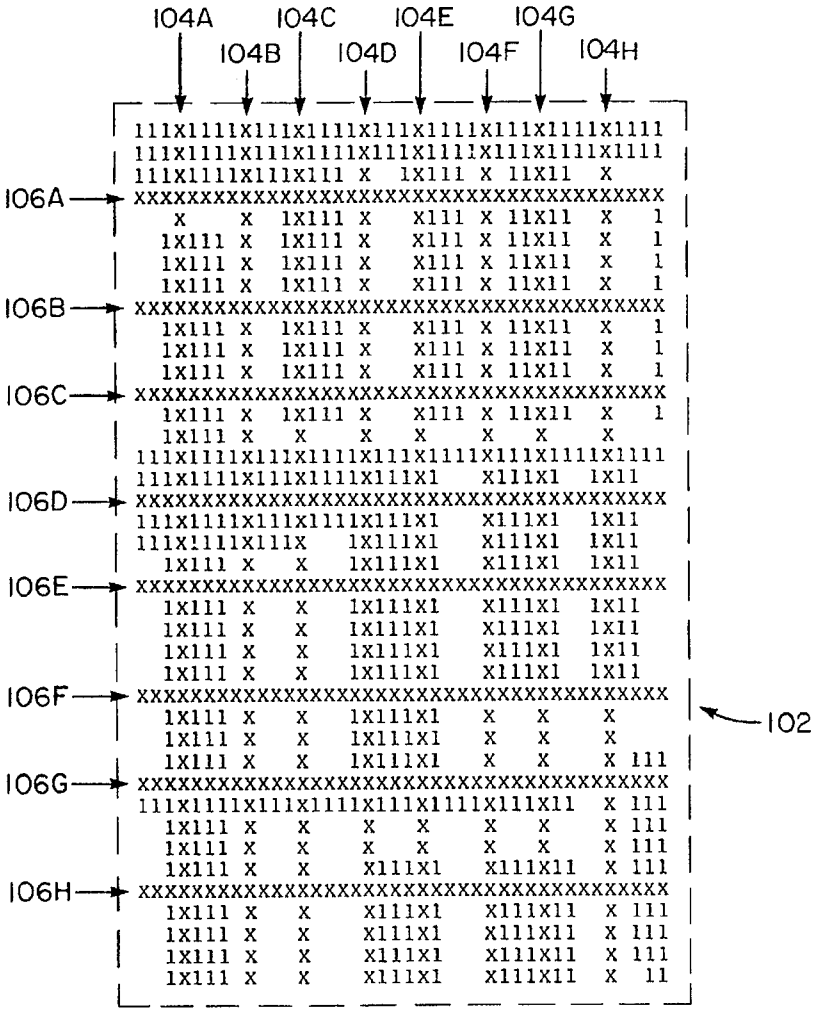
FIG. 3B is a graphical representation of the image in FIG. 3A after expansion according to the present invention.
Figure 3A:
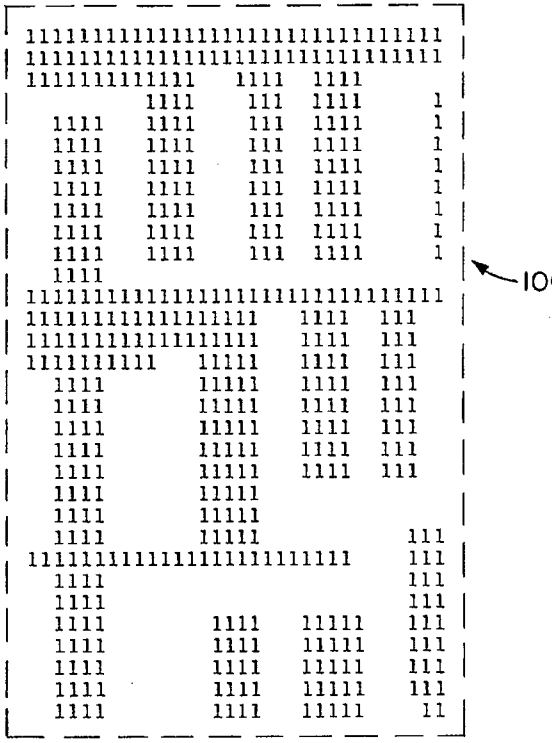
FIG. 3A is a graphical represenation of a portion of an image of an exemplary scene.

The filtered signal passes to analog to digital converter (A/D) 52. A/D 52 converts the signal representing one frame formed by seeker head 12 (FIG. 1) into an array of digital words, each word representing the intensity of the image at a particular point in the field of view of seeker head 12. For simplicity, each digital word here only has one bit and A/D 52 is a comparator. FIG. 3A shows an array of one bit digital words representing one frame from seeker head 12 (FIG. 1). The two values that an entry in the array might have are represented by a "1" or as a blank space.

The digitized frame is passed to correlators 54A and 54B or, when switch 68 is closed, to reference data memory 66. As the missile 10 (FIG. 1) enters the terminal phase, a digitized frame is stored in reference data memory 66. The frame contains the image of some reference point near the target 18 (FIG. 1). For reasons which will become clear from the following description, reference data memory 66 does not need to store the full digitized frame, but only those portions representing objects around the selected reference point.

The digital array stored in reference data memory 66 is passed to both data expanders 56A and 56B. Each data expander produces an expanded reference array which has more entries than the reference array. The reference array is expanded by adding rows and columns of elements. The entries in each added row and column have values indicating they do not correspond to entries representing intensities. For example, in FIG. 3B, an expanded array is shown with each entry in an added row 104A . . . 104H and in an added column 106A . . . 106H depicted by an "X". The X's do not represent intensities.

It can be seen that each entry in the expanded array could have one of three possible values, a "1" indicating a higher intensity or a blank indicating a lower intensity, or an "X" which does not indicate an intensity. Thus, at least two bits are needed to represent each entry in an expanded reference array.

The expanded reference array 102 (FIG. 3B) is larger than the reference array 100 (FIG. 3A). It should be recalled that the images in successive frames from seeker head 12 (FIG. 1) "grow" as the missile 10 (FIG. 1) approaches its target 18 (FIG. 1). By appropriately selecting the number of rows and columns added to array 100 (FIG. 3A), the increase in size of the expanded reference array 102 (FIG. 3B) will match the increase in size of objects in successive frames. The manner in which targeting system 14 (FIG. 2) determines how many rows and columns to add is described in greater detail below. Suffice it to say here that the targeting system 14 (FIG. 2) selects the number of rows and columns to add to compensate for changes in the way objects grow in successive frames formed by seeker head 12 (FIG. 1).

The expanded arrays from data expanders 56A and 56B are applied as inputs to correlators 54A and 54B. Digitized frames from seeker head 12 (FIG. 1) are also applied as inputs to correlators 54A and 54B. Correlators 54A and 54B compare the expanded arrays to the digitized frame.

It will be recalled that reference data memory 66 stores only a portion of an array as a reference array. Even after the reference array is expanded, it is smaller than the digitized frame. Thus, in comparing the expanded reference array to the digitized frame, the expanded reference array could be aligned with any of a number of subarrays in the digitized frame. Correlators 54A and 54B align the expanded reference array with each possible subarray in the digitized frame and compute a score for each subarray.

The method of computing a score is described in more detail below. Suffice it to say here, though, that the higher the score, the closer the match between the expanded reference array and the subarray of the digitized frame. Correlators 54A and 54B select the subarray in the digitized frame producing the highest score. The location of the selected subarray represents the location of the reference area in the digitized frame and can be used by guidance command computer 60 to steer missile 10 (FIG. 1).

Both correlator 54A and correlator 54B, however, select a subarray in the digitized frame corresponding to the reference array, but the guidance command computer 60 generates only one set of guidance commands. Comparator 62 and multi-plexer (MUX) 58 select one of the subarrays for use by guidance command computer 60. Comparator 62 compares the scores for the subarrays selected by correlator 54A and correlator 54B. Comparator 62 then generates a control signal to MUX 58 to select the output of the correlator 54A or 54B which produced the highest score (i.e. the best match).

The location of the subarray producing the best score and that score are passed through MUX 58. The location of the subarray in the digitized frame is passed to guidance command computer 60 which generates control signals in a known fashion. The value of the score is passed to expander logic 64.

Figure 4:
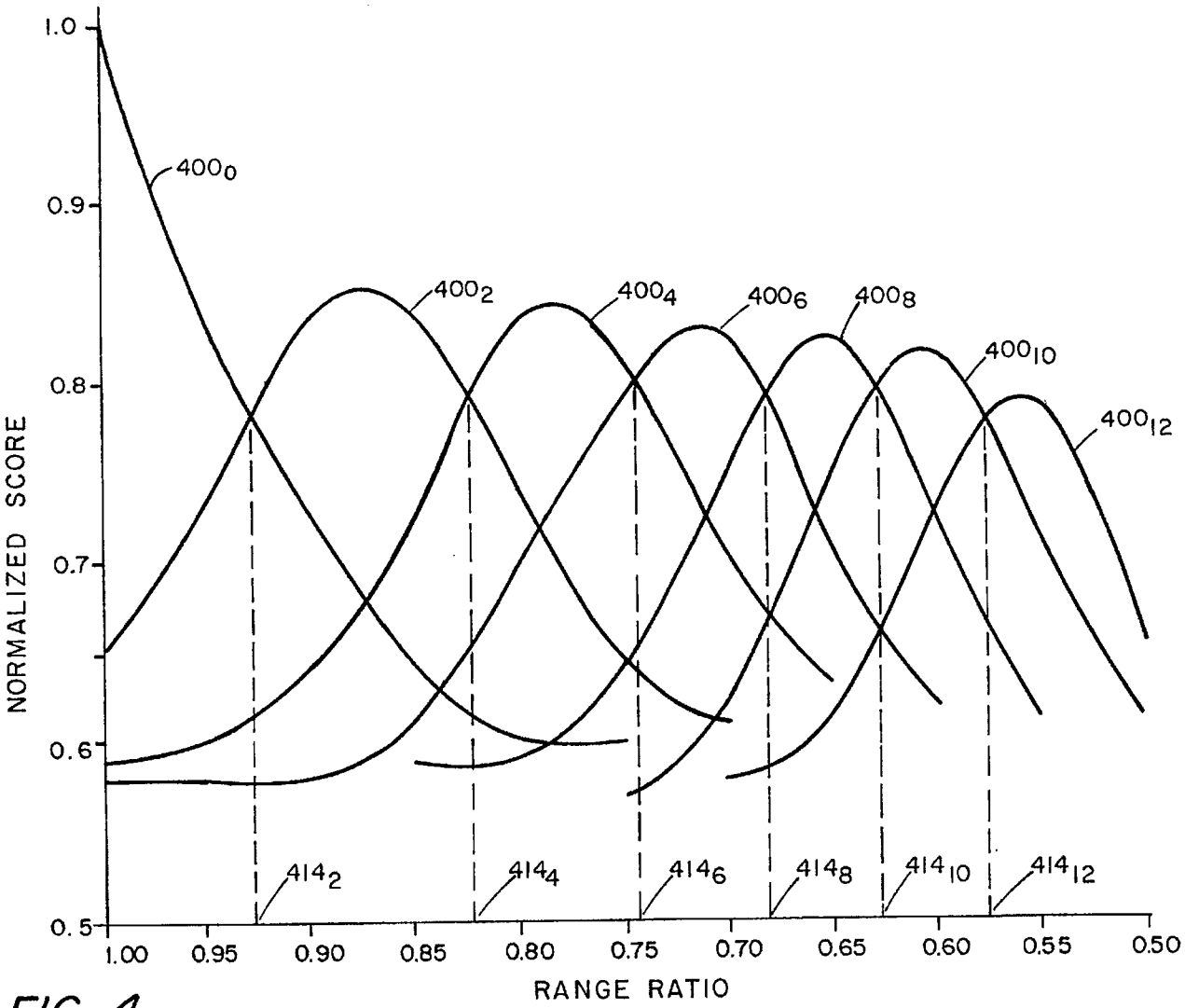
FIG. 4 is a graph useful in understanding the operation of the image correlator in FIG. 2.

Expander logic 64 generates control signals for data expanders 56A and 56B dictating how many rows and columns to add to the reference array (i.e. how much to expand the reference array). FIG. 4 is a graph useful in understanding how the required amount of expansion is selected.

FIG. 4 is a graph of scores produced by a correlator such as correlator 54A or 54B. The reference array is stored at a first range between the missile 10 and target 18 (FIG. 1). The digitized frames are derived from frames made by seeker head 12 (FIG. 1) at successively smaller ranges. The abscissa of the graph in FIG. 4 represents the range as a ratio to the first range. For example, an abscissa of 0.50 indicates scores computed for a frame made at one-half of the first range. The ordinate reflects the scores as a ratio to the score computed at the first range. The multiple curves $\mathbf{400}_0$, $\mathbf{400}_2$, $\mathbf{400}_4$, $\mathbf{400}_6$, $\mathbf{400}_8$, $\mathbf{400}_{10}$ and $\mathbf{400}_{12}$ represent scores computed using different sized expanded reference arrays. The curves represent zero, four, eight, twelve, sixteen, twenty and twenty-four added rows and columns, respectively.

Two useful patterns may be observed in FIG. 4. First, it may be noted that for any given range, one expansion produces the highest score. Further, the number of rows and columns which must be added to produce the highest score increases as the range ratio gets smaller. Crossover points $\mathbf{414}_2$, $\mathbf{414}_4$, $\mathbf{414}_6$, $\mathbf{414}_8$, $\mathbf{414}_{10}$ and $\mathbf{414}_{12}$ indicate the largest range ratios at which four, eight, twelve, sixteen, twenty and twenty-four added rows and columns produce the highest score. For example, as the range ratio decreases from slightly more than range ratio $\mathbf{414}_4$ to slightly less than range ratio $\mathbf{414}_4$, the number of added rows and columns which produces the highest score increases from two to four.

In general, if data expander 56A operates to add two more rows and columns to the reference array than data expander 56A, a higher score from correlator 54B indicates one of the crossover points $\mathbf{414}_2 \ldots \mathbf{414}_{12}$ has been passed. Expander logic 64 then generates control signals for data expander 56A to expand the reference array by two more rows and columns as data expander 56B used to produce the higher score. Data expander 56B simultaneously is controlled to expand the reference array by two more rows and columns. Correlator 54A will then produce the higher score until the range ratio decreases to the next one of the crossover points $\mathbf{414}_2 \ldots \mathbf{414}_{12}$. At the next one of the crossover points $\mathbf{414}_2 \ldots \mathbf{414}_{12}$, correlator 54B will again produce a higher score. Expander logic 64 again controls data expanders 56A and 56B to add two more rows and columns to the expander reference array. The process repeats in this fashion and the amount of expansion producing the best score is selected.

A second pattern observable in FIG. 4 is that as the range decreases, the highest obtainable score decreases. For example, at a range ratio of approximately 0.88, the highest obtainable score is approximately 0.84 with an expansion of two rows and columns (curve $\mathbf{400}_2$). In contrast, at a range ratio of 0.56, the highest obtainable score is approximately 0.79 with an expansion of twelve rows and columns (curve $\mathbf{400}_{12}$). Thus, the highest attainable normalized score dropped from 0.88 to 0.79.

A low score indicates that no subarray in the digitized frame matches the expanded reference array very closely. The poorer matching implies that the expanded reference array is more likely to be matched with a subarray of the digitized frame other than the subarray representing the reference point around target 18 (FIG. 1) as desired. For example, when the score is low, a smoke cloud drifting through the field of view of seeker head 12 (FIG. 1), movement of target 18 (FIG. 1) or other effects which might be characterized as noise could readily cause correlators 54A and 54B to match an incorrect subarray of the digitized frame to the expanded reference array.

To prevent incorrect matching, expander logic 64 also examines the scores computed by correlators 54A and 54B (and selected by MUX 58). If that score drops below a predetermined threshold, say a normalized score of 0.75, a new reference array is stored. Expander logic 64 activates switch 68 such that the subarray of the digitized frame matching the expanded reference array is stored in reference data memory 66. Thus, a new reference array is stored. When a new reference array is stored, logic 64 also resets the control signals to data expanders 56A and 56B such that data expander 56A adds zero rows and columns into the reference array and data expander 56B adds two rows and columns into the reference array.

As described above, expander logic 64 also provides a control signal which alters the passband of video filter 50. It will be recalled that the signal through video filter 50 represents the intensities of objects in the field of view of seeker head 12 (FIG. 1). A little thought will reveal that the frequency components of the signal correspond to the spatial variations of the intensities of the objects in the field of view. Moreover, as the missile 10 (FIG. 1) approaches the target 18 (FIG. 1), objects in the field of view seem bigger and the frequency of the spatial variations is lower. Thus, the passband of video filter 50 should be at successively lower frequencies as the missile 10 (FIG. 1) approaches the target 18 (FIG. 1). A little thought will reveal that the center frequency of video filter 50 should change with the range ratio. For example, video filter 50 might have a center frequency of 500 KHz when the reference array is stored in reference data memory 66 when missile 10 is at a first range from the target. When missile 10 (FIG. 1) reaches a range one-half the first range, the center frequency of video filter 50 should be 250 KHz. Thus, the passband of video filter 50 is adjusted as missile 10 nears the target 18 (FIG. 1).

FIG. 4 indicates a manner in which expander logic 64 (FIG. 2) can determine which center frequency video filter 50 (FIG. 2) should have. The range ratio, which in turn indicates the center frequency, can be estimated by the number of added rows and columns which produce the highest score. For example, when two added rows and columns (curve $400_2$) produce the best score, the range ratio is between crossover point $414_2$ and $414_4$. The center frequency of video filter 50 could be set for some intermediate range ratio, say 0.87. Thus, when expander logic 64 determines that two added rows and columns produce the best score, video filter 50 should be adjusted to have a center frequency approximately 85% of the center frequency when the reference array was stored. Appropriate center frequencies for video filter 50 can likewise be determined for when four, six, eight, etc. added rows produce the best score.

As described above, data expanders 56A and 56B expand a reference array by adding rows and columns of entries in the array. To map entries from the reference array to the expanded reference array, the following formulas are used:

$$\text{ROW 2}=\text{ROW 1}+\text{INT}\,[(((\text{NCOLADD}+1)*\text{ROW 1})-1)/\text{NCOL}] \qquad \text{EQ. 1}$$

and $$\text{COL 2}=\text{COL 1}+\text{INT}\,[(((\text{NROWADD}+1)*\text{COL 1})-1)/\text{NROW}] \qquad \text{EQ. 2}$$

where

ROW 1 and COL 1 are the row and column positions, respectively, of an entry in the reference array;

ROW 2 and COL 2 are the row and column positions, respectively, of an entry in the expanded reference array;

NROW is the total number of rows in the reference array;

NCOL is the total number of columns in the reference array;

NCOLADD is the number of columns added to the reference array;

NROWADD is the number of rows added to the reference array;

INT is a function which truncates its argument to an integer.

Each of the elements in the expanded array which are not assigned values by EQ. 1 and EQ. 2 are assigned the value represented by an "X". A little thought will reveal that the entries represented by "X"'s form the added rows and columns. Further, the added rows and columns are as evenly spaced as possible in the expanded reference array.

As described above, correlators 54A and 54B match the expanded reference array to a portion of the digitized array. In the matching, the expanded reference array is "aligned" with a portion of the digitized frame such that there is a one to one correspondence between each entry in the expanded reference array and a pixel in the portion of the array. The corresponding pixels are processed to produce a score. The score equals the total number of entries in the expanded reference array which have values equaling the value of a corresponding pixel. Since no pixel in the digitized frame has a value designated "X", the entries in the expanded reference array are essentially ignored for computing a score.

The expanded reference array is next aligned with a different portion of the digitized frame and a score is computed for that portion of the frame. A score is computed in a like fashion for every possible portion of the digitized frame and the portion with the highest score is selected. That portion is deemed to match the reference array. The score for that portion and the location of that portion within the digitized frame are passed to guidance command computer 60 and expander logic 64 for processing as described above. The missile is, thus, guided toward its target.

Several advantages of guiding a missile according to the present invention can be seen from the foregoing description. For example, the system constructed according to the invention adjusts the reference array for changing range without having the measurement of the actual range available.

Additionally, the present system requires very few updates of the reference array during a missile intercept. Since each update of the reference array could potentially introduce error into the system, minimizing the number of updates enhances system performance.

Yet another advantage of the present system might be observed in FIG. 4. As described above, expander logic 64 (FIG. 2) determines the range ratio by detecting when one of the crossover points $414_2 \ldots 414_{12}$ has been reached. Other systems in a missile could use such information to determine the "time to go" (i.e. the number of seconds until the missile reaches the target). A little thought will reveal that the time to go can be computed from the rate of change of the range ratio. In a missile, knowing the time to go might be used, for example, to arm the missile at the appropriate time or to adjust the guidance commands to improve the probability of striking the target.

Having described one embodiment of the present invention, it will be apparent that numerous other embodiments could be made. For example, all or parts of targeting system 14 could be constructed from a microprocessor programmed to perform the functions described above. As another example, the number of rows and columns added to expand the reference array need not increase in steps of two, but could increase in steps of any size. In yet another embodiment, frames might be represented by arrays of digital words with each digital word having more than one bit. Therefore, it is felt that the invention should be defined only by the scope of the appended claims.

What is claimed is:

1. In a missile having a seeker head which forms successive frames containing images of a target area, each such frame represented by an array of digital words, an improved method of guiding the missile toward a target comprising the steps of:

(a) selecting a portion of a first frame as a reference array;

(b) expanding the reference array by a first amount to form a first expanded reference array and expanding the reference array by a second amount to form a second expanded reference array;

(c) correlating a second frame to the first expanded reference array to produce a first correlation score and a first indication of target location and correlating the second frame to the second expanded reference array to produce a second correlation score and a second indication of target location;

(d) generating missile guidance commands in response to the first correlation score, the second correlation score, the first indication of target location, and the second indication of target location; and (e) selecting the first and second amounts to expand the reference array in response to the first and second correlation scores and repeating steps b, c, d, and e.

2. The method of claim 1 additionally comprising the step of:

(a) filtering the frames from the seeker head with a filter having a pass band adapted in response to the first and second correlation scores.

3. A correlation tracker for producing an output in response to successively formed input images comprising:

(a) means for storing a reference image;

(b) a first means for expanding the reference image a first amount in response to a first control input;

(c) a second means for expanding the reference image a second amount in response to a second control input;

(d) a first correlator means, responsive to the first expanding means and to the successively formed input images, for producing a first correlation score and a corresponding result indicating a portion of the input image;

(e) a second correlator means, responsive to the second expanding means and to the successively formed input images, for producing a second correlation score and a corresponding correlation result indicating a portion of the input image; and (f) logic means, responsive to the first correlator means and the second correlator means, for selecting the larger of the first correlation score and the second correlation score and the correlation result corresponding to the selected correlation score.

4. The correlation tracker of claim 3 additionally comprising a filter connected between the input wherein the successively formed input images are filtered by a filter having a pass band which varies in response to a control signal produced by the logic means.

* * * * *